US008400314B2

(12) United States Patent
Dittmer et al.

(10) Patent No.: US 8,400,314 B2
(45) Date of Patent: Mar. 19, 2013

(54) FIRE ALARM

(75) Inventors: Hauke Dittmer, Fehmarn Ot. Bannesdorf (DE); Dirk Siemer, Rethwisch (DE); Peter Zuelzer, Hamburg (DE); Bernd Ziems, Zarpen (DE); Axel Grothoff, Neumuenster (DE); Arne Stamer, Siebenbaeumen (DE); Kurt Lenkeit, Suelfeld (DE)

(73) Assignee: Minimax GmbH & Co. KG, Bad Oldesloe (DE)

( * ) Notice: Subject to any disclaimer, the term of this patent is extended or adjusted under 35 U.S.C. 154(b) by 260 days.

(21) Appl. No.: 12/800,298

(22) Filed: May 12, 2010

(65) Prior Publication Data

US 2010/0289650 A1 Nov. 18, 2010

(30) Foreign Application Priority Data

May 13, 2009 (EP) ..... 09006433

(51) Int. Cl.
*G08B 17/12* (2006.01)

(52) U.S. Cl. ..... 340/578; 340/577; 340/579; 220/323; 220/324; 250/339.14; 250/339.15; 356/237.1; 356/239.1; 356/239.2; 356/239.7; 356/239.8

(58) Field of Classification Search ..... None
See application file for complete search history.

(56) References Cited

U.S. PATENT DOCUMENTS

| | | | | | |
|---|---|---|---|---|---|
| D204,916 | S | * | 5/1966 | Blevins | D10/106.5 |
| 3,924,921 | A | * | 12/1975 | Feightner | 439/732 |
| 3,952,196 | A | | 4/1976 | Larsen | |
| 4,160,163 | A | | 7/1979 | Nakauchi | |
| 4,233,596 | A | | 11/1980 | Okamoto et al. | |
| 4,463,260 | A | | 7/1984 | Ikeda | |
| 4,547,673 | A | * | 10/1985 | Larsen et al. | 250/554 |
| 4,826,316 | A | * | 5/1989 | Odum | 356/239.7 |
| 4,929,093 | A | * | 5/1990 | Suzuki et al. | 374/208 |
| 5,257,013 | A | | 10/1993 | Lewkowicz | |
| 5,311,167 | A | * | 5/1994 | Plimpton et al. | 340/578 |
| 5,812,270 | A | * | 9/1998 | Hampton et al. | 356/394 |
| 5,914,489 | A | | 6/1999 | Baliga et al. | |
| 6,239,435 | B1 | | 5/2001 | Castleman | |

(Continued)

FOREIGN PATENT DOCUMENTS

| | | |
|---|---|---|
| AT | 381 406 | 10/1986 |
| CH | 628 171 | 2/1982 |

(Continued)

OTHER PUBLICATIONS

European Search Report dated Oct. 14, 2009 with English translation of same.

*Primary Examiner* — Benjamin C Lee
*Assistant Examiner* — Rajsheed Black-Childress
(74) *Attorney, Agent, or Firm* — Collard & Roe, P.C.

(57) ABSTRACT

A fire alarm consists of a housing in which sensors, a radiation source, and an optical window are disposed. A reflector protection basket or ring is disposed above the optical window. The basket or ring is suitable for protecting the optical window against mechanical influences, allows UV and IR radiation to pass through to a sufficient degree, and reflects UV and IR radiation from the housing interior, on its inside. Monitoring of the contamination of the window, function monitoring of the sensors and of the signal processing electronics, as well as easy replaceability of the components in the fire alarm are provided.

9 Claims, 7 Drawing Sheets

U.S. PATENT DOCUMENTS

| | | | | |
|---|---|---|---|---|
| 6,271,763 | B1 * | 8/2001 | Hur | 340/693.12 |
| 6,731,207 | B1 * | 5/2004 | Swieboda et al. | 340/501 |
| 7,948,617 | B2 * | 5/2011 | Shubinsky et al. | 356/237.1 |
| 2005/0003845 | A1 * | 1/2005 | Pollard | 455/521 |
| 2005/0195086 | A1 | 9/2005 | King | |
| 2006/0007009 | A1 * | 1/2006 | Hess et al. | 340/628 |
| 2008/0157984 | A1 * | 7/2008 | Li et al. | 340/584 |
| 2008/0296502 | A1 | 12/2008 | Kudoh | |
| 2009/0051551 | A1 * | 2/2009 | Pham et al. | 340/577 |
| 2009/0256712 | A1 * | 10/2009 | Eiden et al. | 340/577 |

FOREIGN PATENT DOCUMENTS

| | | |
|---|---|---|
| DE | 31 40 678 | 5/1982 |
| DE | 42 40 395 | 6/1994 |
| DE | 203 06 590 | 8/2003 |
| DE | 10 2008 024 496 | 12/2008 |
| EP | 0 078 443 | 5/1983 |
| EP | 0 926 647 | 6/1999 |
| FR | 2 380 542 | 9/1978 |
| GB | 2 020 417 | 11/1979 |
| GB | 2 065 880 | 7/1981 |

* cited by examiner

FIRE ALARM

CROSS REFERENCE TO RELATED APPLICATIONS

Applicants claim priority under 35 U.S.C. 119 of European Application No. 09006433.8 filed May 13, 2009.

BACKGROUND OF THE INVENTION

1. Field of the Invention

The invention relates to a fire alarm having a housing with a sensor, at least one radiation source, and an optical window. A reflector protection basket or ring is disposed above the optical window to protect the optical window and allow UV and IR radiation to pass through and reflect radiation from the housing interior.

The invention can be used wherever fire alarms are used to detect a fire and IR or UV radiation occurs, which is measured after it has passed through an optical window. Contamination of the optical window and function are monitored, and protection against mechanical damage of the window allows interference-free detection of fire phenomena.

2. The Prior Art

Fire alarms for detecting optical fire phenomena have been known for a long time. They generally consist of a housing, in which sensor elements and corresponding signal processing electronics are disposed. An optical window closes off the housing in the direction of the fire phenomenon to be detected. Radiation enters the housing through the optical window, and is detected by a sensor. However, the optical window can become dirty, thereby causing less radiation to enter the housing, and errors can occur in the detection. Furthermore, the result of the detection can be distorted by influences such as sunbeams, shadows, and the like. Furthermore, the optical window is exposed to mechanical influences that can lead to destruction or at least damage. In industrial areas or areas at risk of dust explosions, high demands are made on the seal and the mechanical strength of the housing and the optical entry window. A possible failure or disruption of the sensors and the signal processing electronics can also severely impair the reliability and availability of the fire detection. After installation and startup of a fire alarm, the alarm might have to be replaced after a certain period of time, for technical reasons or due to a change in the fire risk, by a fire alarm having the same construction, a fire alarm having different specification data, such as a different sensitivity class, for example, or even by a fire alarm that detects a different fire characteristic, for example heat or combustion gases. This requires a high level of installation effort. With known fire alarms, the entire alarm has to be removed and all of the cabling connections to the electrical power and the connection to a central fire alarm or a different reception device have to be disconnected. Subsequently, the new fire alarm has to be installed and connected with cables. This requires additional costs, and during the long time of refitting, no fire protection by means of automatic detection is guaranteed.

German Patent Application DE 42 40 395 A1 describes a detector for detecting electromagnetic radiation with a sensor element disposed in a housing that does not allow the radiation to pass through, under a cover disk that does allow the radiation to pass through. This element responds to electromagnetic radiation and generates an electrical output signal as a function of the radiation. The contamination of the cover disk is measured, in that the electromagnetic radiation of a radiation source is passed onto the cover disk, in other words the optical window, and measured in the interior of the detector as a measure of the contamination.

A similar device is described in U.S. Pat. No. 5,914,489, in which a light beam is passed from above, by a radiation source, onto the optical window, and is detected by a sensor below the optical window to the extent that the radiation penetrates the optical window, so that conclusions are possible with regard to the degree of contamination of the optical window.

In both solutions, the optical window is not protected against mechanical influences.

U.S. Pat. No. 5,257,013 describes a flame detector on the underside of which protection against mechanical stresses in the form of brackets or deflectors is disposed. However, the detector has no large-area optical window, and the mechanical protection does not monitor the degree of contamination of the entry window or to monitor the function of the sensors.

It is a further disadvantage of the available fire alarms that they each must be adjusted or converted in accordance with the fire event to be expected.

German Patent No. DE 203 06 590.5 describes a housing shell for a fire alarm that allows rapid conversion. An embodiment for a fire alarm is neither described nor indicated.

U.S. Pat. No. 4,547,673 describes a flame or smoke alarm having a radiation receiver element and maximally two radiation sources. This alarm has specially disposed reflectors. The reflective elements are optimized in such a manner that they influence a minimum of the surface of the entry window. It is disadvantageous that these reflectors do not offer sufficient mechanical protection, because of the geometric conditions (large optical window and small reflectors, in terms of area) and because of a lack of embodiments relating to the ability of the reflector material to withstand stress.

The recognition of fires by fire alarms can lead to false alarms if sunlight, artificial light, welding, heating devices, or other interference sources distort the result.

Furthermore, regulations provide that for fire alarms used in spaces at risk of explosion, the housing must be able to sustain great mechanical demands without damage, for example from strong impact or vibrations. The optical entry window must be sufficiently protected against these influences. In areas at risk of dust explosion, great demands are made on the chemical resistance of all the seal materials, as well as on the resistance resulting from ambient influences.

U.S. Pat. No. 3,952,196 A describes a UV fire alarm having a UV receiver element and UV transmitter, which alarm has a crosspiece with reflective elements above the optical window. The crosspiece and the reflective elements are only provided for contamination monitoring of the optical window. Because of the geometric conditions (large optical window and small crosspiece, in terms of area), this reflector does not guarantee sufficient mechanical protection. Also, no function monitoring of the sensors and of the signal processing electronics is provided. Furthermore, the reflector cannot be easily replaced. Since the holder of the reflector holds the optical window at the same time, replacement of the reflector is complicated. Without this part, however, the alarm is unable to function, since the optical window otherwise does not have any hold in the present method of construction.

SUMMARY OF THE INVENTION

It is therefore an object of the invention to develop a fire alarm whose optical window is protected against mechanical influences, whereby contamination monitoring of the optical window must be present, and easy replaceability of components should be present.

This task is accomplished according to the invention by a fire alarm consisting of a housing in which sensors, one or more radiation sources, and an optical window are disposed. A reflector protection basket or ring is disposed in the housing on top of the optical window, which basket or ring is suitable for protecting the optical window against mechanical influences, allows IR (infrared) and UV (ultraviolet) radiation to pass through to a sufficient degree, and is suitable for reflecting UV and IR radiation on its inside.

A replaceable metal grid that has a mirrored surface and is elastic can be viewed as the most advantageous embodiment variant of the reflector protection basket.

It is also possible to produce the reflector protection basket or ring from elastically durable plastic that is chrome-plated or mirrored on its surface. The elastic reflector protection basket can have crosspieces that are connected with one another, which terminate in an accommodation flange around the optical window with their ends, and engage into a depression or a groove in the accommodation flange, and therefore are attached in a stable manner. For this purpose, wide and narrow tabs can be configured, which are introduced into recesses of different width in the accommodation flange and anchored in it. The reflector protection basket can cover the entire surface of the window, as a concave hood, which can easily be compressed by hand by the operator, inserted, or twisted in as a bayonet closure, removed, and replaced. However, the reflector protection basket or ring can also cover only a specific region at the edge of the optical window. However, under some circumstances, it is sufficient to guide only one or more protective strips over the optical window in a protective manner.

Removal of the reflector protection basket has no influence at all on the seal of the housing and the ability of the fire alarm to function; in other words, it can be removed or replaced at any time. Furthermore, the major part of the surface of the optical window is protected against mechanical destruction by the reflector protection basket or ring.

It is advantageous to configure the optical window as $CaF_2$, sapphire, or other materials that allow UV/IR light to pass through, such as mica or the like.

It is furthermore advantageous if the housing consists of an upper part and a lower part, and the feed lines for the energy and for the signals, for example to an alarm station, are disposed in the lower part, and the sensors and all the signal processing components are disposed in the upper part. This has the advantage that the upper part, which is replaceable, can be replaced with little effort both for service and repair, and can also be adapted to a different fire risk. The mechanical and electrical installation remains in existence.

The optical window, the reflector protection basket, sensors, the radiation source, and, if applicable, a microcontroller are disposed in the upper housing part, along with an electrical plug-in connection to the lower part.

It is advantageous to dispose IR and/or UV radiation sensors in the upper part. These can, however, be only or additionally imaging sensors. For example, a UV radiation sensor can be disposed in the upper part, which detects a flame signal and the signal of the radiation source. However, one or more IR sensors or a combination of IR and UV sensors is another possibility.

It is furthermore advantageous to dispose the radiation sensors in electrical modules, in a modular manner, on different levels. For example, an IR radiation sensor can be disposed on the level directly underneath the optical window, and a UV radiation sensor can be disposed one level lower.

In order to monitor the optical window, an optical signal is transmitted through the optical window by the radiation source or the radiation sources in the upper part, which signal is reflected at the reflector protection basket and reflected to the IR and/or UV radiation sensor, so that after the beam has passed through the optical window twice, a measure can be obtained indicating what contamination the optical window is demonstrating, and the function of the sensors and of the signal processing electronics can be tested.

One or more IR and/or multiple UV radiation sources can be provided as radiation sources.

Fundamentally, the upper housing part, which is replaceable, can be set onto the lower housing part. For this purpose, rubber seals must be disposed between the housing parts. Other types of seals can also be advantageous. This seal or an additional seal can be configured as an electrically conductive EMC seal. Because of the replaceability of the upper housing part, it is possible to quickly react to current requirements, according to the modular principle, if necessary.

Furthermore, it is advantageous to provide a plug-in connector with a replaceable communications module in the upper housing part.

This could be a relay module that allows stand-alone operation of the alarm without a central fire alarm. Another possible communications module could have the 4.4 . . . 20 mA interface for alarm transmission that is widespread in the industrial sector. Digital communications modules allow communicating with the central fire alarm by way of loop technology, in other words data exchange with the central fire alarm by way of a protocol, and thereby localizing the alarm, retrieving the status of the fire alarm at the central fire alarm, or parameterizing the alarm from the central fire alarm.

Furthermore, it is advantageous to provide an addressing switch in the upper housing part. This makes it possible to set the reporting address for alarm localization as a function of the type of communications module used.

Furthermore, it is advantageous to provide a service interface for contacting a service device for configuration, parameterization, and for software updates, as well as for transmission of history data to a computer or to a database. The service interface can be configured as a connector plug or as a jack.

The invention has the advantage that the optical window is protected against mechanical influences, even when it is large, and monitoring of the contamination of the window, function monitoring of the sensors and of the signal processing electronics, as well as easy replaceability of the components in the fire alarm are provided.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
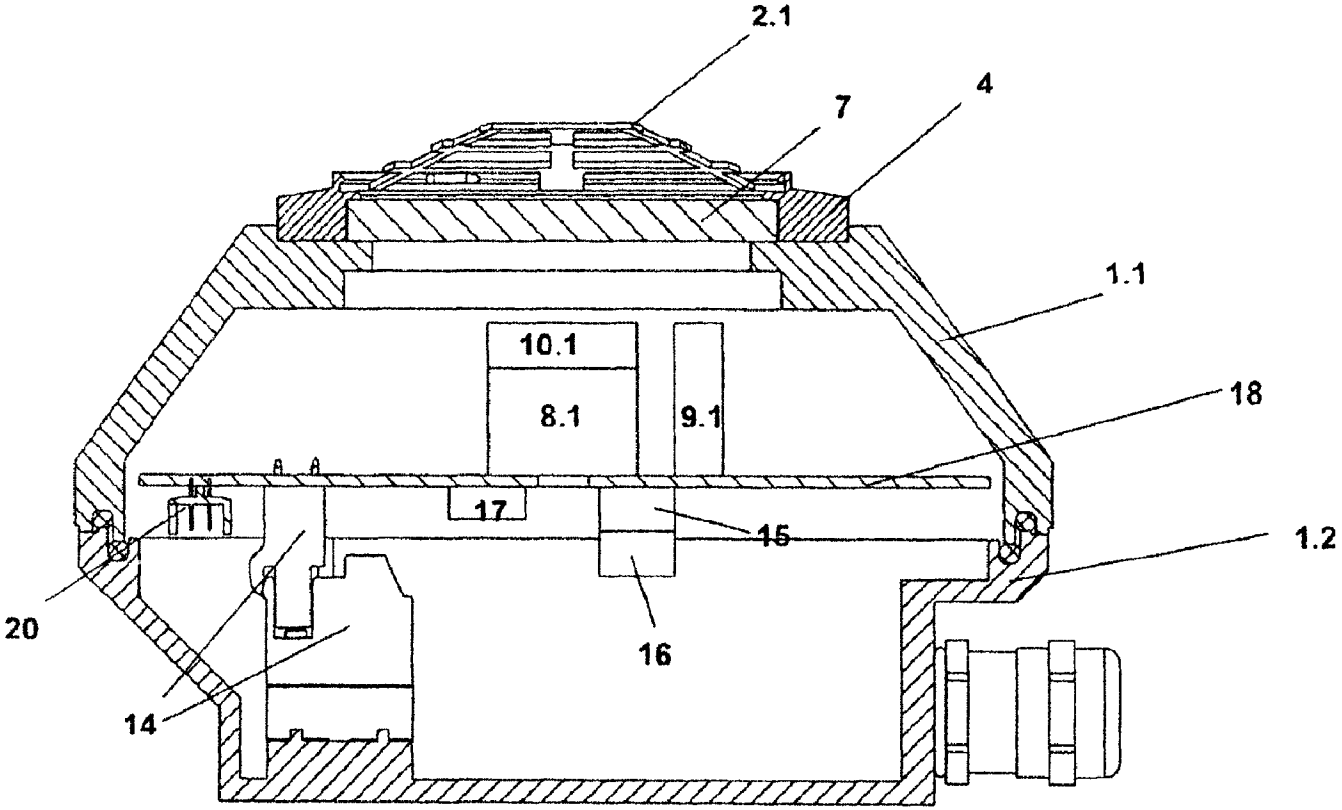
FIG. 1 is a schematic representation of the fire alarm according to one embodiment of the invention, with upper and lower housing part as well as a reflector protection basket.

Referring now in detail to the drawings, FIG. 1, in a schematic representation, shows the fire alarm according to one embodiment of the invention, consisting of an upper housing part 1.1 and a lower housing part 1.2, between which there are seals. Upper housing part and lower housing part 1.1, 1.2 are connected with one another by an electrical plug-in connection 14, in which the signal lines and voltage supplies are disposed. In upper housing part 1.1, an electronic module 18 is situated on one level that consists of the UV radiation sensor 8.1 with the UV filter 10.1, the UV radiation source 9.1, the addressing switch 17, and the communications module 16 with its plug-in connection 15. Optical window 7 consists of sapphire and is held by accommodation flange 4, in which reflector protection basket 2.1 is also disposed. A flame phenomenon that emits UV radiation can be detected in a wavelength range provided, by radiation sensor 8.1. In order to check the degree of contamination of optical window 7, a light signal of the corresponding wavelength is transmitted by radiation source 9.1, which signal is reflected by the reflector protection basket 2.1 and detected by UV radiation sensor 8.1. Reflector protection basket 2.1 protects optical window 7 against mechanical damage and reflects the radiation emitted by UV radiation source 9.1 to UV radiation sensor 8.1. The reflected radiation is used for a contamination analysis of optical window 7 and for function monitoring of the sensors and of the subsequent signal processing. The fire alarm communicates with the central fire alarm by way of replaceable communications module 16. The addressing switch 17, when a digital communications module is used, which makes the alarm a participant in an alarm circuit, assigns an alarm or interference signal to this alarm, with the set address.

Figure 2:
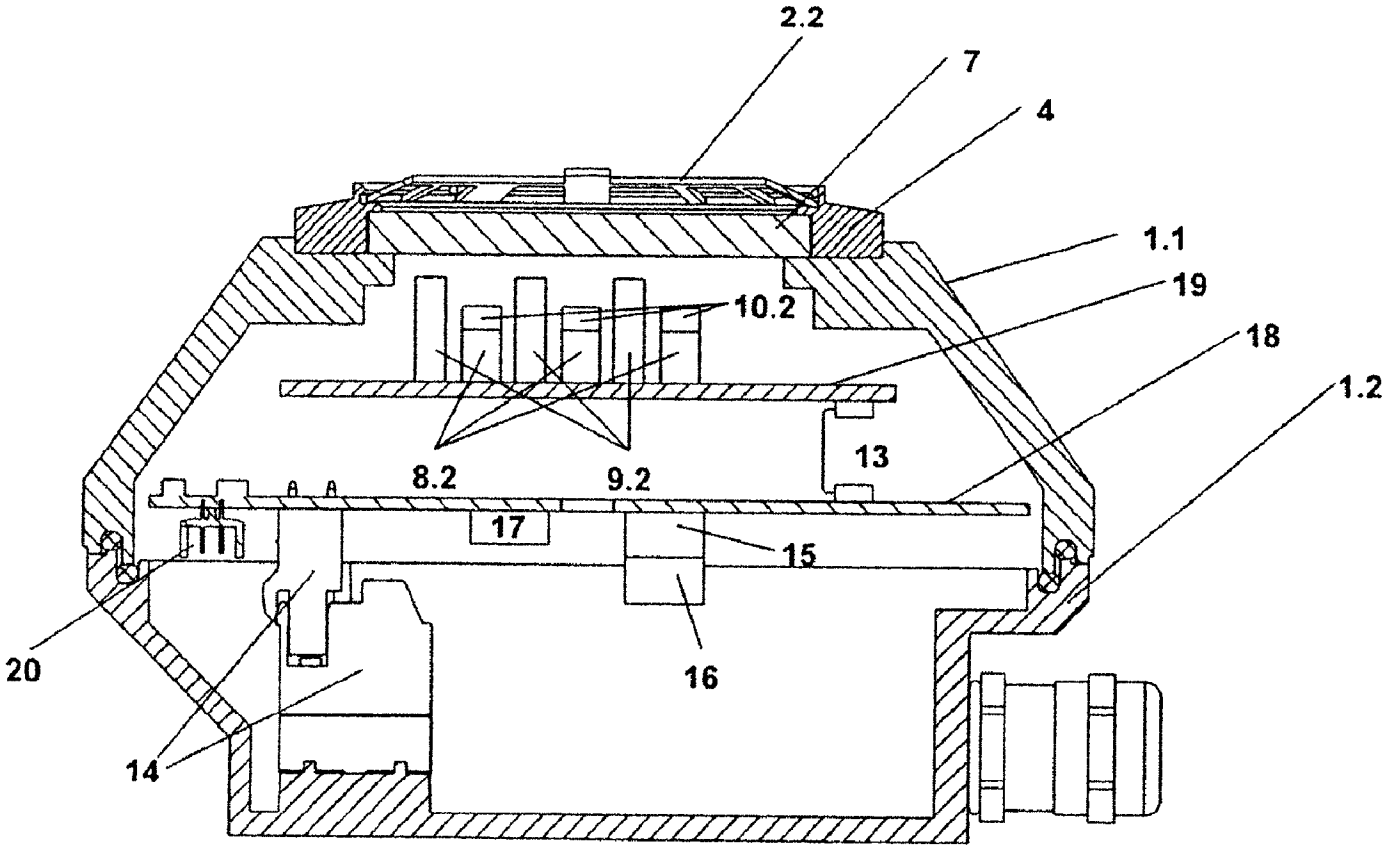
FIG. 2 is a schematic representation of the fire alarm according to another embodiment of the invention, with two levels for the electronic modules and a reflector protection ring.
Figure 3:
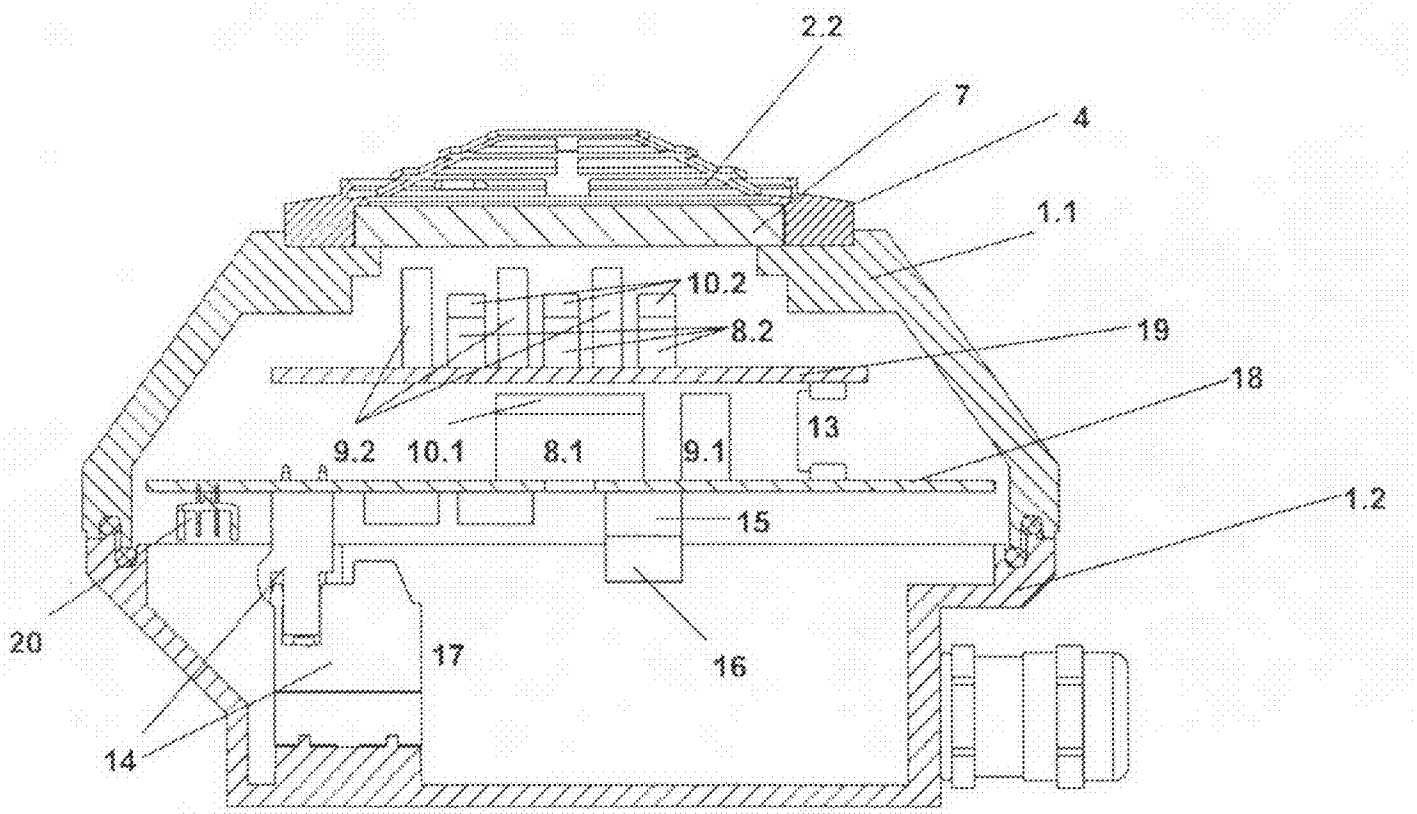
FIG. 3 is a schematic representation of the fire alarm according to another embodiment of the invention, with reflector protection basket and two electronic modules on different levels.

Furthermore, a connector plug is provided as a service interface 20, which can also be seen in FIGS. 2 and 3.

FIG. 2 shows another embodiment of the fire alarm according to the invention, consisting of upper housing part 1.1 and lower housing part 1.2, in which two electronic modules 18, 19 are disposed. The lower electronic module contains the addressing switch 17 and the communications module 16 with plug-in connection 15, and upper module 19 contains three IR radiation sensors 8.2, each having IR filters 10.2 and IR radiation sources 9.2, which emit an IR beam onto the reflector protection ring 2.2, which reflects this beam to IR radiation sensor 8.2 by way of IR filter 10.2. A plug-in connection 13 is disposed between modules 18, 19.

FIG. 3 shows a similar arrangement of the electronic components in a schematic representation, whereby a reflector protection basket 2.1 is situated above optical window 7, and in addition, a UV radiation source 9.1 and a UV radiation sensor 8.1 with UF filter 10.1 are disposed in lower electronic module 18. With this embodiment of the fire alarm, both UV radiation and IV radiation can be detected.

Figure 4:
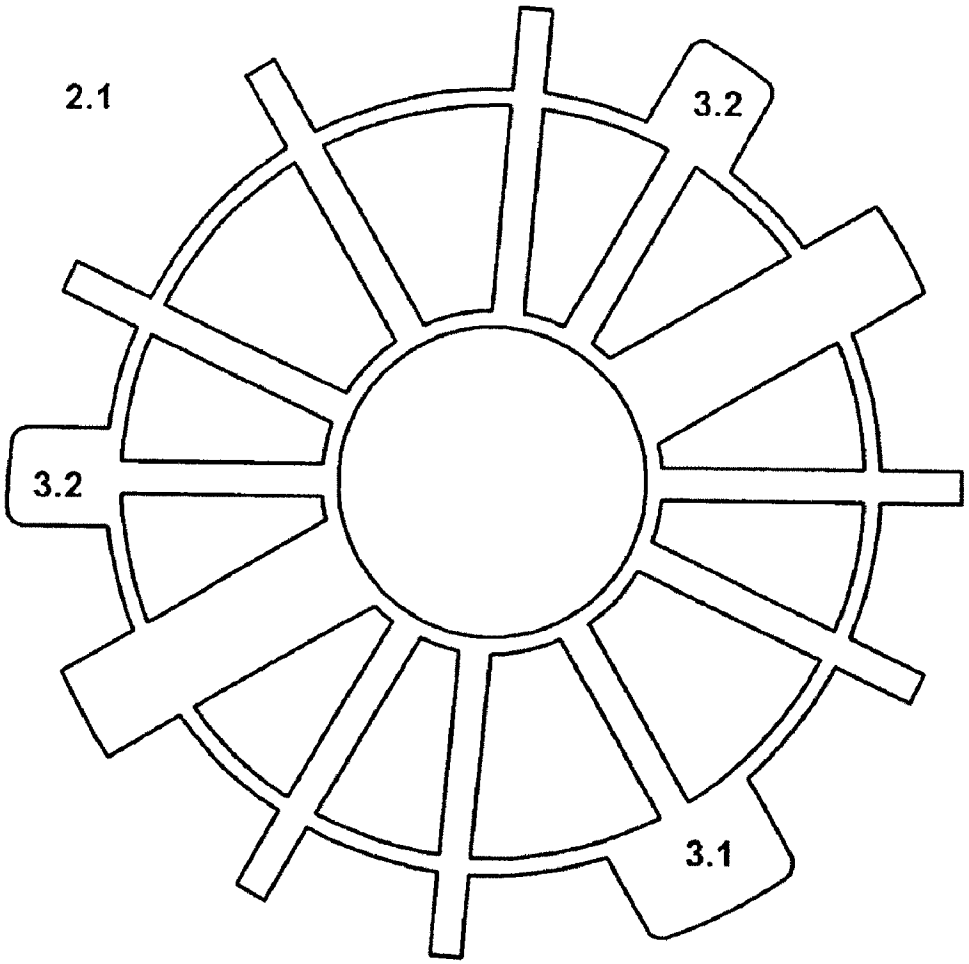
FIG. 4 shows the reflector protection basket.
Figure 6:
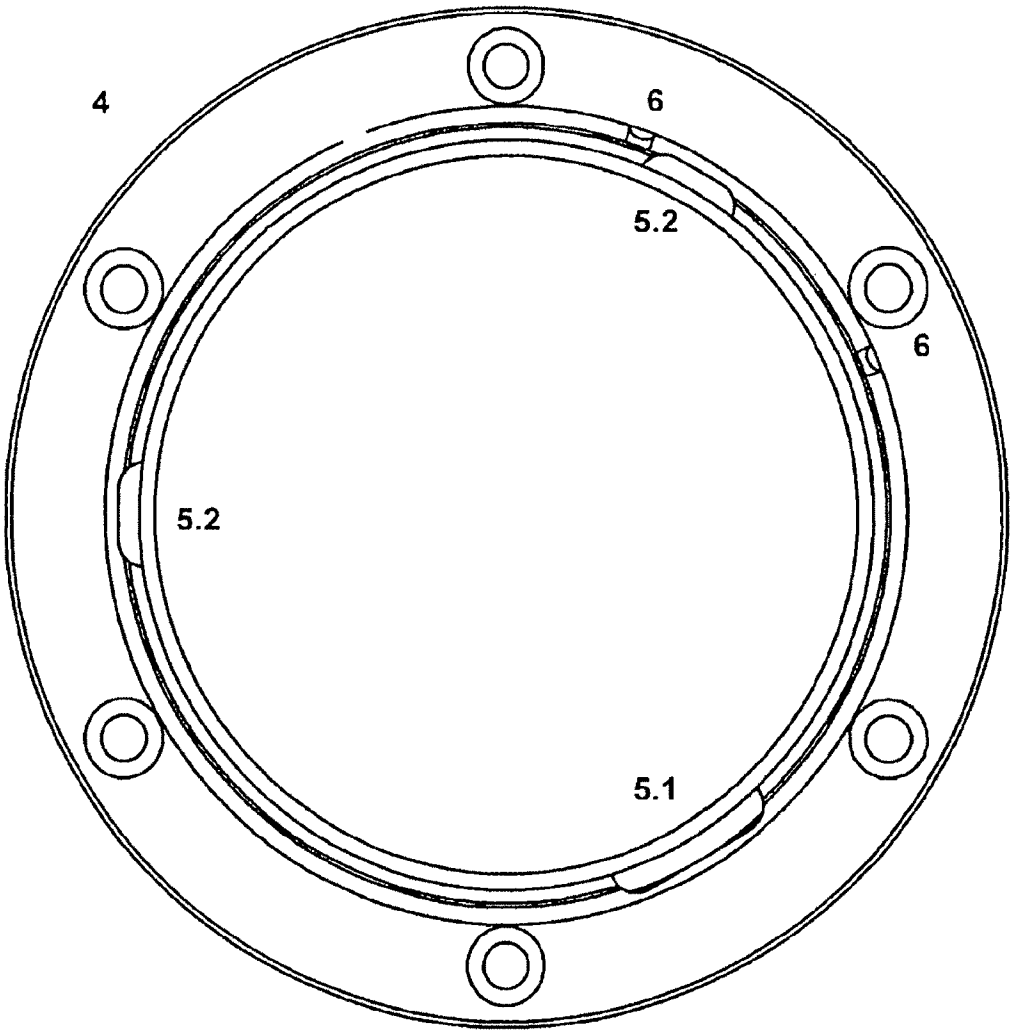
FIG. 6 shows an accommodation flange for the reflector protection basket or the reflector protection ring.

FIG. 4 shows the reflector protection basket 2.1, configured in the shape of a hood, through the interstices of which the UV and/or IR radiation can enter without hindrance. Tabs 3.2, 3.1 having different widths are present, with which the elastic, reflective reflector protection basket 2.1 can be screwed into the accommodation flange 4. The reflector protection basket 2.1 consists of reflective sheet metal, whose tabs 3.2, 3.1 are locked in place, by hand, in the bayonet accommodation or recess 5.1 and 5.2 of flange, as shown in FIG. 6.

Figure 5:
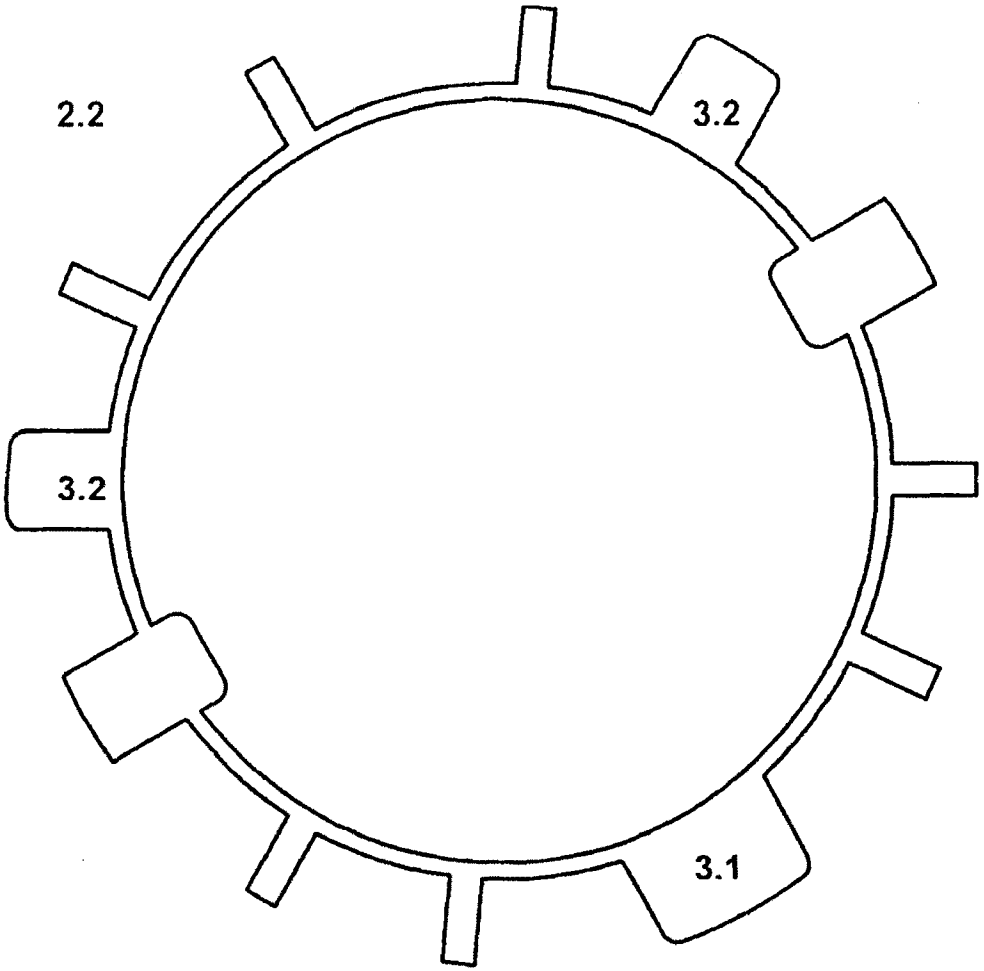
FIG. 5 shows the reflector protection ring.

The same holds true for the reflector protection ring 2.2 shown in FIG. 5, which has a very large areas for allowing the UV and IR radiation to pass through. Both reflector protection basket 2.1 and the reflector protection ring 2.2 can be inserted into recesses 5.1, 5.2 of accommodation flange 4 with their tabs 3.1, 3.2, and can be rotated in it. Contact notch 6 limits this rotational movement. Accommodation flange 4 holds both optical window 7 and the reflector protection basket or the reflector protection ring 2.1, 2.2.

Figure 7:
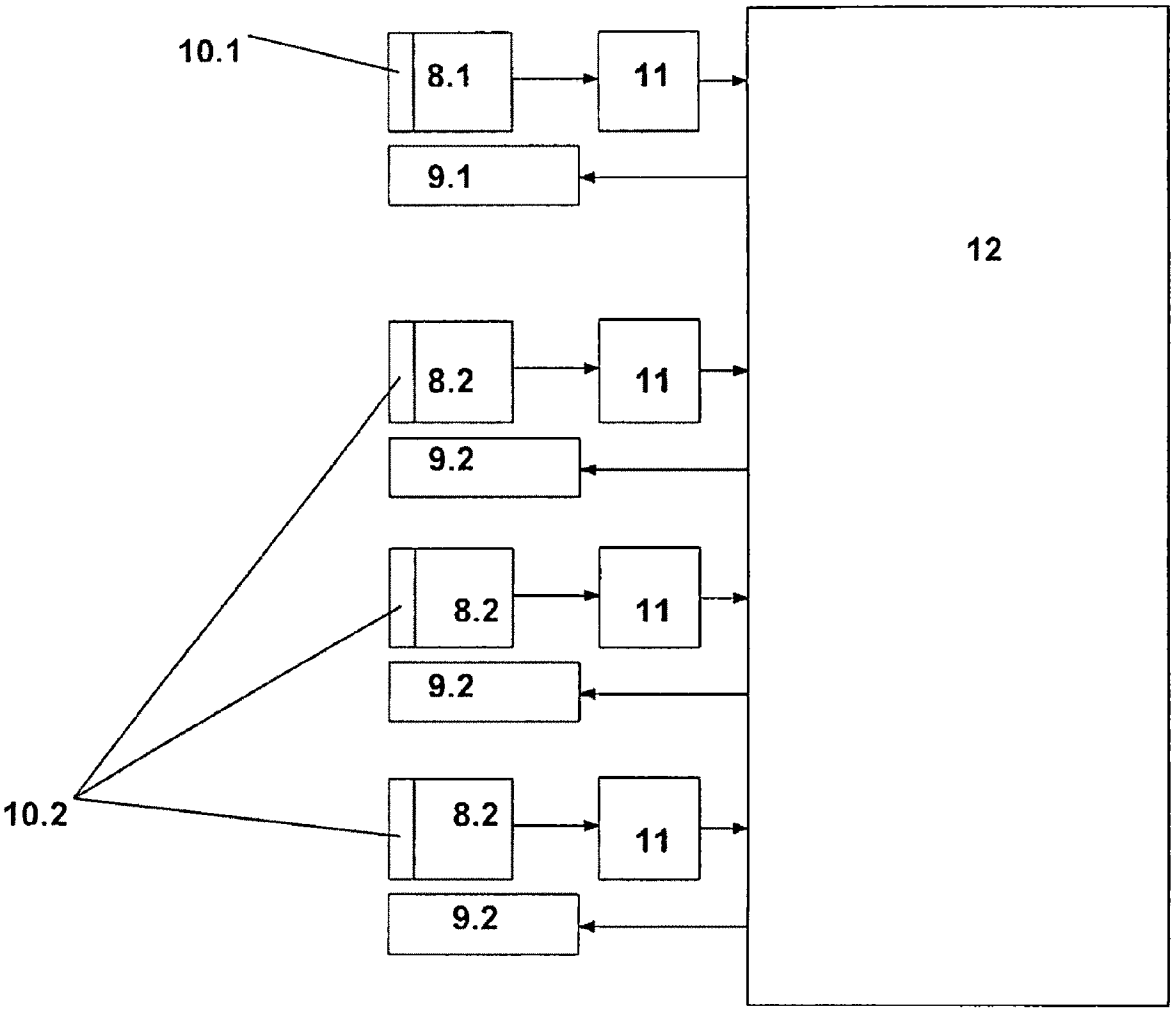
FIG. 7 is a schematic representation of IR sensors for interference-free detection of flames.

FIG. 7 shows the schematic representation of radiation sensors 8.1, 8.2 for interference-free fire detection. Three IR radiation sensors 8.2 with IR filter 10.2 are disposed next to one another, and their signal is passed to a signal processing 11. This signal processing 11 can be an A/D converter, an amplifier, or a signal adaptation that leads to a microcontroller 12 with memory, which processes and stores the signal. Furthermore, an IR radiation source 9.2 is provided, which emits an IR radiation for checking the degree of contamination of the optical window 7. In the same manner, a UV radiation sensor 8.1 with UV filter 10.1 can also be provided. The signal of the sensor is passed on to the microcontroller with memory 12 by way of a signal adaptation, and UV signals can be sent to optical window 7 by a UV radiation source 9.1, to check the degree of contamination and the function of the sensors.

Accordingly, while only a few embodiments of the present invention have been shown and described, it is obvious that many changes and modifications may be made thereunto without departing from the spirit and scope of the invention.

What is claimed is:

1. A fire alarm comprising:

a housing having at least one fire condition sensor, at least one radiation source, and an optical window; and a reflector protection basket or ring disposed on top of the optical window, said reflector protection basket or ring being elastic and protecting the optical window against mechanical stress, while allowing UV and IR radiation emitted by a fire from the exterior to pass through the optical window, and reflecting UV and IR radiation emitted by the at least one radiation source from an interior of the housing back into the interior for testing for contamination of the optical window, said reflector protection basket or ring having cross-pieces that are connected with one another, said cross-pieces having ends in the form of tabs that terminate in an accommodation flange that extends around the optical window, wherein said tabs are configured in different widths from each other and engage into correspondingly sized recesses in the accommodation flange, and wherein the reflector protection basket is adapted to be compressed by hand for insertion and removal from the accommodation flange.

2. The fire alarm according to claim 1, wherein the reflector protection basket or ring is replaceable.

3. The fire alarm according to claim 1, wherein the housing consists of an upper part and a lower part, wherein the optical window, the reflector protection basket or ring, the radiation sensor, and the radiation source are disposed in the upper part, and wherein the lower part contains a connector for feed lines, and an electrical plug-in connection to the upper part.

4. The fire alarm according to claim 3, wherein the radiation sensors in the upper part detect UV or IR radiation, or both.

5. The fire alarm according to claim 3, wherein the upper housing part contains different electronic modules, wherein an upper one of said modules contains the radiation sensor and wherein a plug-in connection is disposed between the modules.

6. The fire alarm according to claim 3, further comprising a plug-in device with a replaceable communications module disposed in the upper housing part.

7. The fire alarm according to claim 3, wherein an addressing switch is disposed in the upper housing part.

8. The fire alarm according to claim 1, wherein the protection basket or ring consists of sheet metal or plastic.

9. The fire alarm according to claim 1, further comprising a service interface for contacting a service device for configuration, parameterization, software updates, and transmission of history data to a computer or to a database.

* * * * *